US006647601B2

(12) United States Patent
Kim

(10) Patent No.: US 6,647,601 B2
(45) Date of Patent: Nov. 18, 2003

(54) METHOD FOR MAKING A BLANKET HAVING A HIGH PILE DENSITY AND A BLANKET MADE THEREFROM

(76) Inventor: William B. Kim, 3200 Union Pacific Ave., Los Angeles, CA (US) 90023

( * ) Notice: Subject to any disclaimer, the term of this patent is extended or adjusted under 35 U.S.C. 154(b) by 104 days.

(21) Appl. No.: 10/095,761

(22) Filed: Mar. 13, 2002

(65) Prior Publication Data

US 2003/0172505 A1 Sep. 18, 2003

(51) Int. Cl.[7] ..... D06C 7/02; D03D 27/12
(52) U.S. Cl. ..... 28/159; 28/143; 156/72
(58) Field of Search ..... 28/100, 103, 140, 28/143, 144, 151, 159, 160, 162, 163, 165, 167; 26/2 R; 156/72, 252, 253, 148, 84; 428/85, 95, 97; 139/2, 391, 392, 396, 399

(56) References Cited

U.S. PATENT DOCUMENTS 2,238,098 A * 4/1941 Bradshaw ..... 28/159
2,327,278 A * 8/1943 Lurie ..... 28/159
2,908,013 A * 10/1959 Keen et al. ..... 28/159
3,024,518 A * 6/1962 Newton ..... 28/159
3,383,259 A * 5/1968 Cochran II ..... 28/159
3,847,719 A * 11/1974 Crowley ..... 156/72
4,439,476 A * 3/1984 Guild ..... 156/72
4,668,552 A * 5/1987 Scott ..... 428/97
4,668,553 A * 5/1987 Scott et al. ..... 156/72
5,598,615 A * 2/1997 Takada ..... 28/159

* cited by examiner

*Primary Examiner*—Amy B. Vanatta
(74) *Attorney, Agent, or Firm*—Park & Sutton LLP; John K. Park

(57) ABSTRACT

A method for making a blanket is provided. The blanket is made from a fabric that has a ground having wefts and warps, and piles inserted in spaces between the wefts and warps of the ground. The method comprises the steps of weaving the fabric from the wefts, the warps, and the piles, coloring the fabric with a predetermined pattern, heating the fabric to bind the piles firmly, cutting the fabric to a predetermined size for the blanket, and surrounding the edges of the cut fabric with a cloth. The wefts and warps are made of a ground yarn, and the piles are made of an acrylic yarn. The weight percentage of the acrylic yarn in the fabric is in the range between approximately 80 and 95, and the weight percentage of the ground yarn in the fabric is the remainder.

17 Claims, 3 Drawing Sheets

METHOD FOR MAKING A BLANKET HAVING A HIGH PILE DENSITY AND A BLANKET MADE THEREFROM

BACKGROUND OF THE INVENTION

The present invention relates to a method for making a blanket. More particularly, the invention relates to a method for making a blanket having a high pile density.

A fabric for a blanket is made by weaving a ground with a low-grade yarn such as a polyester yarn or a cotton yarn, and inserting piles in the spaces between the wefts and warps of the ground. A high-grade yarn such as an acrylic yarn is used as piles. Increasing the ratio of pile yarns against ground yarns, that is inserting piles denser, enhances the quality of the blanket, such as the feel or the appearance of the blanket. However, there has been a limit to increase the ratio due to the problem of inserting piles densely in the narrow spaces between the wefts and warps of the ground, and preventing the densely inserted piles from falling out when the blanket is in use.

Accordingly, there has been a demand for an improved method for increasing the ratio of piles in the finished blanket-like products.

SUMMARY OF THE INVENTION

The present invention is contrived to overcome the conventional disadvantages. Therefore, an object of the invention is to provide a method for making a blanket with denser piles.

Another object of the invention is to provide a blanket having a high-grade feel and appearance.

Still another object of the invention is to provide a durable blanket with denser piles.

To achieve the above-described objects, in accordance with an embodiment thereof, the invention provides a method for making a fabric. The fabric has a ground having wefts and warps, and piles inserted in spaces between the wefts and warps of the ground. The method comprises the steps of weaving the fabric from the wefts, the warps, and the piles, and heating the woven fabric such that the wefts and the warps contract to bind the piles firmly. The wefts and warps are made of a ground yarn, and the piles are made of an acrylic yarn. The weight percentage of the acrylic yarn in the fabric is in the range between approximately eighty (80) and ninety-five (95), and the weight percentage of the ground yarn in the fabric is the remainder.

Preferably, the ground yarn is made of polyester, cotton, or a blend of polyester and cotton.

Preferably, the step of heating is performed by immersing the fabric in hot water and then drying the fabric. Alternatively, the heating is performed with ultrasonic wave, or microwave.

In accordance with another embodiment of the present invention, the heating has the effect of welding the wefts, the warps and the piles together. Heat is concentrated where the piles bound to the wefts and the warps. The heating is performed with ultrasonic wave, or microwave.

A blanket is made from the fabric manufactured according to the above-described methods. The method for making a blanket from the fabric comprises the steps of weaving the fabric from the wefts, the warps, and the piles, coloring the fabric with a predetermined pattern, heating the fabric such that the wefts and the warps contract to bind the piles firmly, cutting the fabric to a predetermined size for the blanket, and surrounding the edges of the cut fabric with a cloth.

The advantages of the present invention are numerous in that: (1) a blanket having a high-grade feel and appearance can be provided; (2) piles of the blanket do not fall out of the ground even after prolonged use; and (3) easy method of increasing pile density in a blanket is provided.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
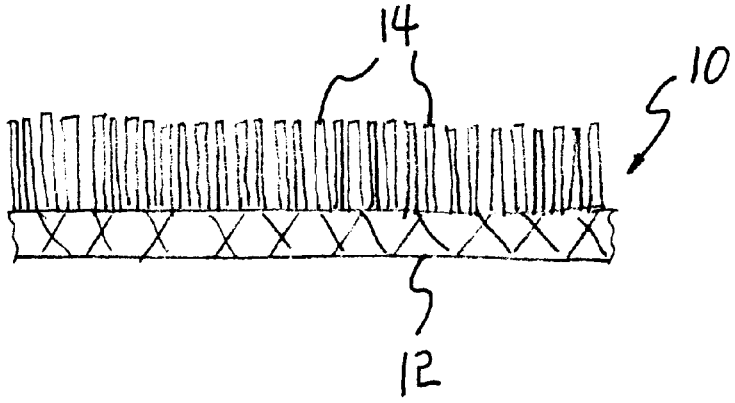
FIG. 1 is a schematic illustrative view showing a fabric having a ground and piles bound to the ground on one side of the ground.

FIG. 1 shows a fabric 10 for making a blanket. The fabric 10 has a ground 12 and a plurality of piles 14 bound to the ground 12. The piles 14 are bound to the ground 12 on one side of the ground 12. The piles 14 protrude from the ground 12 and are spaced very densely. As the density of the piles 14 increases, the quality such as feel and appearance of the fabric and hence the quality of the blanket made of the fabric improves. As a yarn for piles, a high-grade yarn, such as an acrylic yarn is used for its superior feel, appearance and thermal insulation. As yarns for warps and wefts of the ground, low-grade yarns such as polyester, cotton, and a blend of them, etc. are used. The quality of a blanket may be checked by comparing the percentage of the piles. If the weight percentage of piles is below 70%, the quality of the blanket is so poor. As the percentage increases, the feel of the blanket becomes smooth and silky. The present invention provides a method for making a fabric for a blanket that has a weight percentage of the acrylic yarn in the range between approximately eighty (80) and ninety-five (95), and the weight percentage of the ground yarn is the remainder.

Figure 2:
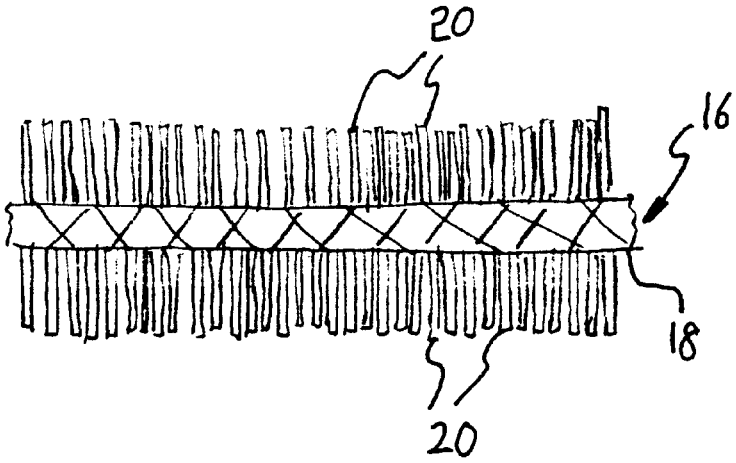
FIG. 2 is a view similar to FIG. 1 wherein the piles are bound to on both sides of the ground.

FIG. 2 shows another fabric 16 for making a blanket. The fabric 16 has a ground 18 and a plurality of piles 20 bound to the ground 18 on both sides of the ground 18.

Figure 3:
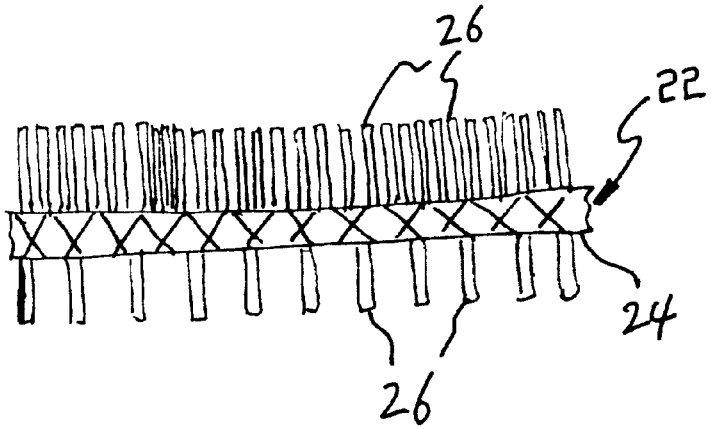
FIG. 3 is a view similar to FIG. 1 wherein dense piles are bound on one side of the ground and short, sparse piles are bound on the other side of the ground.

FIG. 3 shows another fabric 22 for making a blanket. The fabric 22 has a ground 24 and a plurality of piles 26 bound to the ground 24 on one side of the ground 24. There are some portions of piles that are wound around the wefts and warps of the ground 24 on the other side of the ground 24. After binding the piles 26 to the ground 24, the other side of the ground 24 is scratched so that the portions of the piles 26 are cut and protrude from the ground 24. The piles 26 on the other side of the ground 24 are shorter and less dense.

Figure 6:
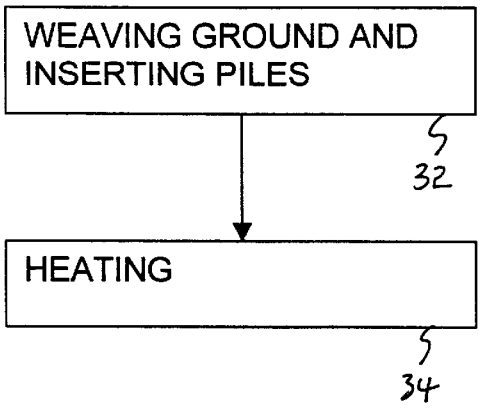
FIG. 6 is a flow diagram showing a method of making the fabric.

FIG. 6 shows a flow diagram for the method of making the fabric. The first step 32 of the method of the present invention is weaving the ground 12, 18, 24 and inserting piles 14, 20, 26. Inserting piles may be done at the same time that the ground is weaved or after the ground is weaved. After the piles are inserted, the inserted piles are cut to a predetermined length. The density of the piles is controlled so that the weight percentage of the piles, that is, acrylic yarn is in the range between 80 and 95.

Figure 4:
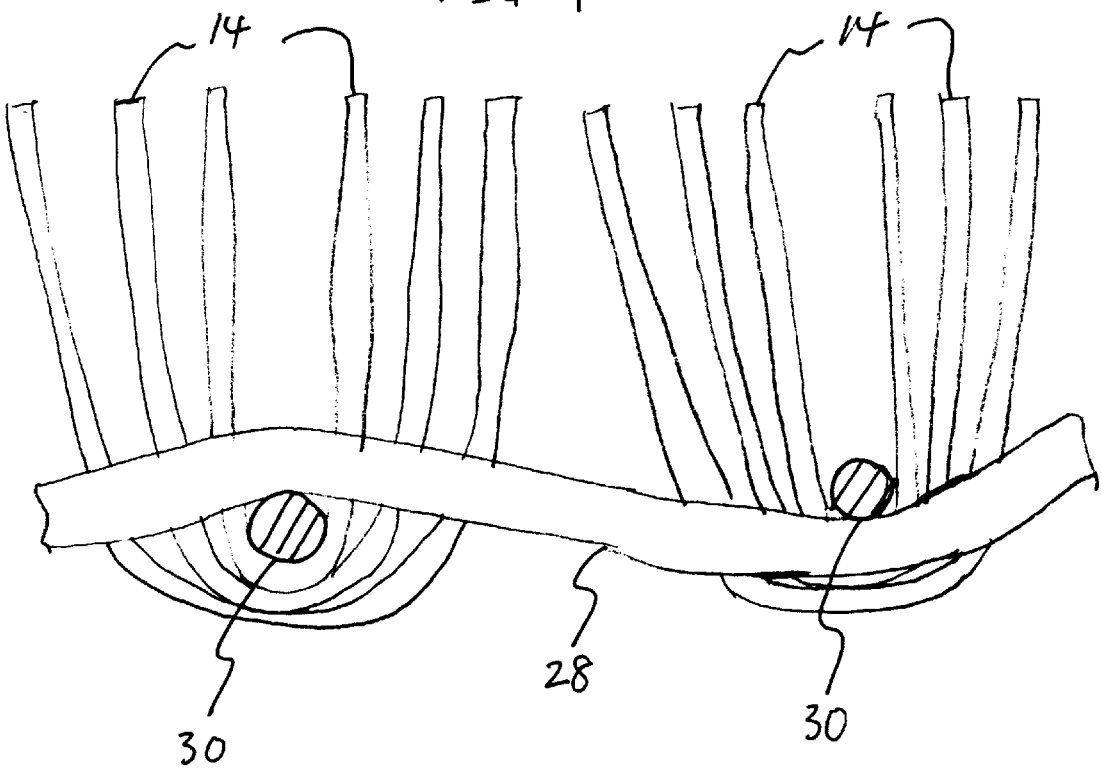
FIG. 4 is a partial elevational view showing the piles and the ground before heating.

FIG. 4 shows the state that the piles 14 are inserted between wefts 28 and warps 30 of the ground 12, and wound around the wefts 28 and the warps 30. As the piles 14 are inserted more densely, that is as the weight percentage of the piles 14 increases, the spaces between the wefts 28 and warps 30 of the ground 12 becomes wider. The widened spaces allow increasing demand of mechanical tolerance to insert the piles more densely. However, the possibility that the piles would fall out of the ground during the service life of the blanket increases. The present invention overcomes this problem by heat-treating the piles and the ground.

Figure 5:
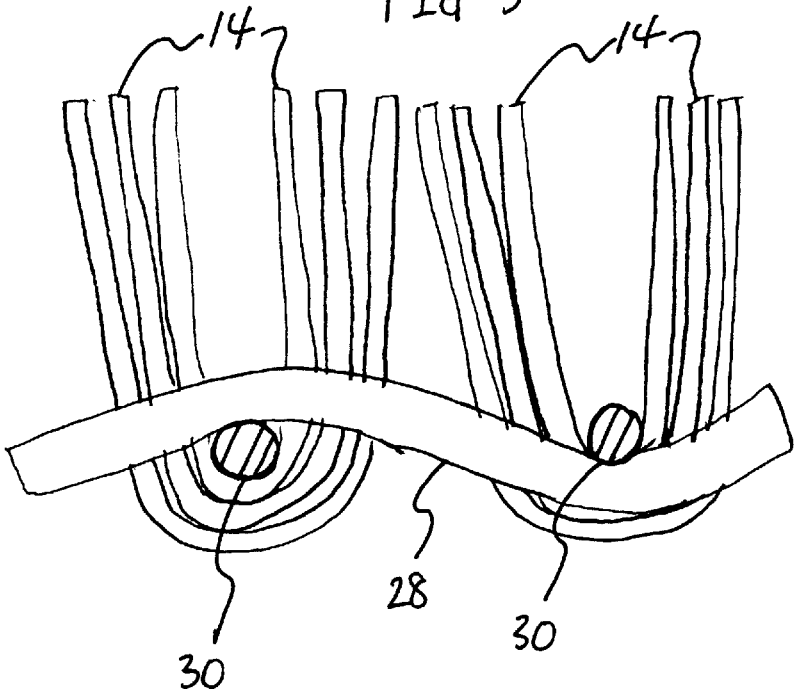
FIG. 5 is a partial elevational view showing the piles and the ground after heating.

The second step 34 of the method of the present invention is heating. Preferably, the heating step 34 is performed by immersing the entire fabric 10, 16, 22 in hot water and then drying the fabric. Alternatively, the heating step 34 may be performed by heating the fabric with ultrasonic wave or with microwave. The heating step 34 has the effect of contracting the wefts 32, the warps 34, and the piles 14, 20, 26 so that the spaces between the wefts 32 and warps 34 are narrowed and thus the piles 14, 20, 26 are tightly bound to the ground 12, 18, 24, respectively. FIG. 5 shows that the piles are tightly bound to the ground after the heating step 34.

In addition, the piles 14, 20, 26 may be welded to the wefts 28 and warps 30. Ultrasonic wave energy or microwave energy is concentrated to the portion where the piles are wound around the wefts and the warps so that they partially melt and weld together. Other portions of the piles and the ground yarns, that is, the wefts and the warps do not weld since they receive substantially lower energy that the portion where the piles are wound around the ground yarns.

Table 1 below shows examples of compositions of fabrics for making blankets according to the present invention.

TABLE 1

| | COMPOSITION | | |
|---|---|---|---|
| 1 | PILE | 100% ACRYLIC SPUN YARN RAW WHITE 2/32 SMM, BRIGHT HIGH BULKY ON CONE | 83.5% |
| | GROUND | 65% POLYESTER (S/D) 35% CARDED COTTON BLENDED SPUN YARN 10'S/1 IN GREY ON CONE | 11.5% |
| | | 100% POLYESTER F. YARN 150D/ 48F (R/W) (S/D) | 5% |
| 2 | PILE | 100% ACRYLIC SPUN YARN R/W 2/32'S (BR) | 90% |
| | GROUND | 100% POLYESTER F/YARN 150D R/W S/D | 10% |
| 3 | PILE | 100% ACRYLIC SPUN YARN RAW WHITE 2/32 SMM, BRIGHT HIGH BULKY ON CONE | 80% |
| | GROUND | 65% POLYESTER (S/D) 35% CARDED COTTON BLENDED SPUN YARN 10'S/1 IN GREY ON CONE | 12% |
| | | 100% POLYESTER F.YARN 250D/ 48F (R/W) (S/D) | 8% |
| 4 | PILE | 32 SMM 100% ACRYLIC HIGH BULKKY BRIGHT YARN RW ON CONE | 80% |

TABLE 1-continued

| | COMPOSITION | | |
|---|---|---|---|
| | GROUND | POLYESTER 65% (S/D) COTTON 35% P. E. YARN 10'S/1 ECC RAW WHITE | 12% |
| | | 100% POLYESTER F. YARN 250D/ 48F (R/W) (S/D) | 8% |
| 5 | PILE | 100% ACRYLIC SPUN YARN R/W 2/32 BR HIGH BULKY | 89% |
| | GROUND | POLYESTER F. YARN RAW WHITE 150D (S/D) POLYESTER 65% (S.D) CARDED COTTON 35% | 5% |
| | | BLENDED OPEN-END SPUN YARN NE 20' S/1 R/W ON CONE | 6% |
| 6 | PILE | 100% ACRYLIC SPUN YARN RAW WHITE 2/32 SMM BRIGHT HIGH BULKY ON CONE | 82% |
| | GROUND | POLYESTER (S/D) 70% CARDED COTTON 30% BLENDED SPUN YARN 10'S/1 IN GREY | 12% |
| | | 100% POLYESTER F. YARN 150D/48F (R/W) (S/D) | 6% |
| 7 | PILE | 100% ACRYLIC SPUN YARN R/W 2/32'S BR HIGH BULKY | 87% |
| | GROUND | POLYESTER F. YARN RAW WHITE +50D (SD) POLYESTER 80% CARDED COTTON 20% BLENDED | 5% |
| | | OPEN0END SPUN YARN NE 20'S/1 R/W ON CONE | 8% |

Figure 7:
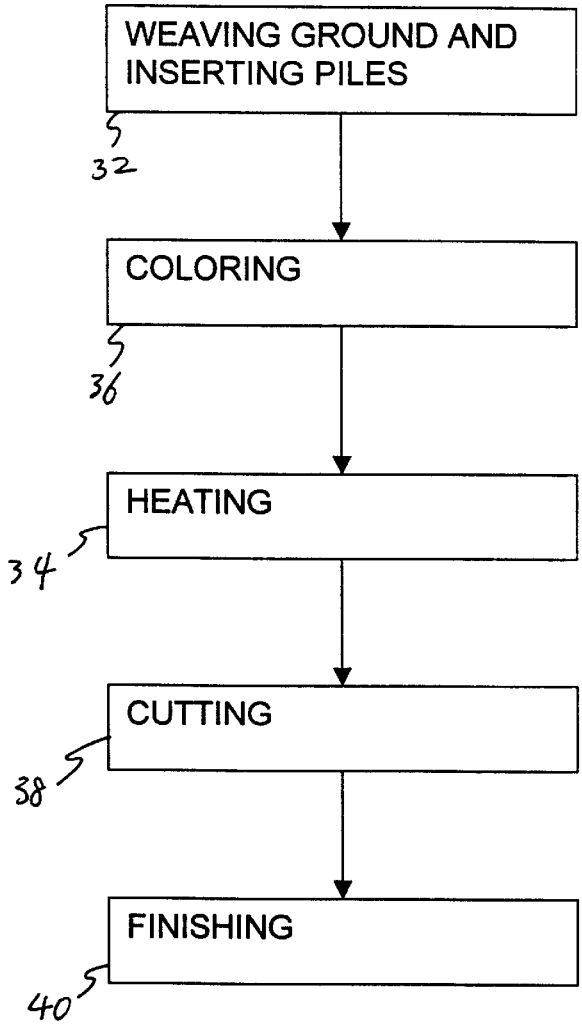
FIG. 7 is a flow diagram showing a method of making a blanket with the fabric.

FIG. 7 shows a flow diagram for making a blanket from the fabric made according to the above methods. A coloring step 36 is provided between the step of weaving ground and inserting piles 32 and the step of heating 34. The coloring step 36 colors the fabric 10, 16, 22 with a predetermined pattern to get desired decorating effect of the blanket.

After the heating step 34, a cutting step 38 cuts the fabric 10, 16, 22 into a predetermined size. The three different fabrics 10, 16, 22 shown in FIGS. 1–3 provide three different kinds of blankets. After the cutting step 38, a finishing step 40 surrounds the open edges of the fabric cut in the cutting step 38 with a cloth to hide and to protect the open edges.

With the above methods, the present invention provides a high quality blankets having a superior and luxurious feel and appearance. The blankets are durable enough to keep the quality during the service life. The methods are easy to implement as part of the process of making blankets.

Although the invention has been described in considerable detail, other versions are possible by converting the aforementioned construction. Therefore, the scope of the invention shall not be limited by the specification specified above and the appended claims.

What is claimed is:

1. A method for making a fabric, wherein the fabric has a ground having a plurality of wefts and warps, and a plurality of piles inserted in spaces between the wefts and warps of the ground, comprising the steps of:

a) weaving the fabric from the wefts, the warps, and the piles; and b) heating the woven fabric such that the wefts and the warps contract to bind the piles firmly;

wherein the wefts and warps are made of a ground yarn, and the piles are made of an acrylic yarn, and wherein the weight percentage of the acrylic yarn in the fabric is in the range between approximately eighty (80) and ninety-five (95), and the weight percentage of the ground yarn in the fabric is the remainder.

2. The method of claim 1 wherein the ground yarn is made of polyester, cotton, or a blend of polyester and cotton.

3. The method of claim 1 wherein the step of heating comprises the steps of immersing the fabric in hot water and then drying the fabric.

4. The method of claim 1 wherein the step of heating comprises the step of heating the fabric with ultrasonic wave.

5. The method of claim 1 wherein the step of heating comprises the steps of heating the fabric with microwave.

6. A fabric made according to the method of claim 1.

7. A method for making a fabric, wherein the fabric has a ground having a plurality of wefts and warps, and a plurality of piles inserted in spaces between the wefts and warps of the ground, comprising the steps of:

a) weaving the fabric from the wefts, the warps, and the piles; and b) heating the woven fabric such that the wefts, the warps and the piles weld together;

wherein the wefts and warps are made of a ground yarn, and the piles are made of an acrylic yarn, and wherein the weight percentage of the acrylic yarn in the fabric is in the range between approximately eighty (80) and ninety-five (95), and the weight percentage of the ground yarn in the fabric is the remainder.

8. The method of claim 7 wherein the ground yarn is made of polyester, cotton, or a blend of polyester and cotton.

9. The method of claim 7 wherein the step of heating comprises the step of heating the fabric with ultrasonic wave.

10. The method of claim 7 wherein the step of heating comprises the steps of heating the fabric with microwave.

11. A fabric made according to the method of claim 7.

12. A method for making a blanket, wherein the blanket is made from a fabric that has a ground having a plurality of wefts and warps, and a plurality of piles inserted in spaces between the wefts and warps of the ground, comprising the steps of:

a) weaving the fabric from the wefts, the warps, and the piles;

b) coloring the fabric with a predetermined pattern;

c) heating the fabric such that the wefts and the warps contract to bind the piles firmly;

d) cutting the fabric to a predetermined size for the blanket; and e) surrounding the edges of the cut fabric with a cloth;

wherein the wefts and warps are made of a ground yarn, and the piles are made of an acrylic yarn, and wherein the weight percentage of the acrylic yarn in the fabric is in the range between approximately eighty (80) and ninety-five (95), and the weight percentage of the ground yarn in the fabric is the remainder.

13. The method claim 12 wherein the ground yarn is made of polyester, cotton, or a blend of polyester and cotton.

14. The method of claim 12 wherein the step of heating comprises the steps of immersing the fabric in hot water and then drying the fabric.

15. The method of claim 12 wherein the step of heating comprises the step of heating the fabric with ultrasonic wave.

16. The method of claim 12 wherein the step of heating comprises the steps of heating the fabric with microwave.

17. A blanket made according to the method of claim 12.

* * * * *